US008016540B2

(12) United States Patent
Shimoie

(10) Patent No.: US 8,016,540 B2
(45) Date of Patent: Sep. 13, 2011

(54) BOOM

(75) Inventor: Shizuo Shimoie, Sakai (JP)

(73) Assignee: Kubota Corporation, Osaka (JP)

( * ) Notice: Subject to any disclaimer, the term of this patent is extended or adjusted under 35 U.S.C. 154(b) by 165 days.

(21) Appl. No.: 12/067,456

(22) PCT Filed: Mar. 9, 2007

(86) PCT No.: PCT/JP2007/054627

§ 371 (c)(1),
(2), (4) Date: Aug. 20, 2008

(87) PCT Pub. No.: WO2008/018194

PCT Pub. Date: Feb. 14, 2008

(65) Prior Publication Data

US 2009/0134109 A1 May 28, 2009

(30) Foreign Application Priority Data

Aug. 11, 2006 (JP) ..... 2006-219835

(51) Int. Cl.
*E02F 3/00* (2006.01)

(52) U.S. Cl. ..... 414/722; 29/897.2; 29/897.31; 414/694

(58) Field of Classification Search ..... 414/680, 414/694, 722; 29/897.2, 897.31
See application file for complete search history.

(56) References Cited

U.S. PATENT DOCUMENTS 4,392,314 A * 7/1983 Albrecht et al. ..... 414/694
5,822,892 A 10/1998 Ohbatake et al.

FOREIGN PATENT DOCUMENTS

| | | |
|---|---|---|
| JP | 61-165426 | 7/1986 |
| JP | 62-94140 | 6/1987 |
| JP | 62-190747 | 12/1987 |
| JP | 08-134946 | 5/1996 |
| JP | 11-241363 | 9/1999 |
| JP | 2003-328383 | 11/2003 |

* cited by examiner

*Primary Examiner* — Donald Underwood
(74) *Attorney, Agent, or Firm* — The Webb Law Firm

(57) ABSTRACT

A pivoted coupling member of a two-piece boom can be shared with standard booms. The boom comprises a first boom having, on the base end side, a pivoted coupling member that is pivotably coupled to a boom support section, and a second boom in which the base end side is pivotably coupled to the distal end side of the first boom and in which an arm is pivotably coupled to the distal end side. In the boom, the lateral width of the main body portion 51 of the second boom (18B) is designed to be smaller in the second region (Y) of the base end side than the first region (X) of the distal end side, the base end side of the second region (Y) of the second boom (18B) in inserted between the left and right side walls (29) of the distal end side of the first boom (18A), and the second boom (18B) is pivotably coupled to the first boom so as to be capable of rotating about the lateral axis.

6 Claims, 18 Drawing Sheets

BOOM

TECHNICAL FIELD

The present invention relates to a boom of a backhoe or other work machinery.

BACKGROUND ART

Standard booms of backhoes are conventionally integrally formed from a base end side to a distal end side in which the main body portion is composed of left and right side walls and top and bottom walls. In this boom, the base end side is provided with a pivoted coupling member that is curved at a midway point in the lengthwise direction so as to be convex toward the upper side and that is pivotably coupled to the boom support section of the running body. This boom has an arm that is pivotably coupled to the distal end side (see Patent Document 1).

Additionally, an example of a boom whose base end is pivotably coupled to the running body side and whose distal end is pivotably coupled to an arm is a boom (referred to as a two-piece boom) composed of a first boom pivotably coupled to the running body side, and a second boom in which the base end side is pivotably coupled to the distal end side of the first boom so as to be capable of rotation about the lateral axis and in which an arm is pivotably coupled to the distal end side (see Patent Document 2).

Patent Document 1: Japanese Laid-open Patent Application No. 2003-328383

Patent Document 2: Japanese Laid-open Patent Application No. 11-241363

DISCLOSURE OF THE INVENTION

Problems that the Invention is Intended to Solve

In a two-piece boom that has the main body portion of the first and second booms formed from left and right side walls and top and bottom walls, and that is provided with a pivoted coupling member that is pivotably coupled to the boom support section of the running body on the base end side of the first boom, the first and second booms are ordinarily formed so that the lateral widths are substantially uniform from the distal end side to the base end side when the base end of the second boom is inserted between the left and right side walls of the distal end side of the first boom, and are pivotably coupled. For this reason, the lateral width of the first boom is greater than the lateral width of the second boom.

In other words, the lateral width of a standard boom is formed to be substantially uniform from the base end side to the distal end side, but in a two-piece boom, the lateral width of the constituent parts of the base end side of the boom is greater than the lateral width of the constituent parts of the distal end side of the boom.

For this reason, the pivoted coupling members of a two-piece boom are formed in different shapes in comparison with the pivoted coupling members of a standard boom.

On the other hand, the pivoted coupling members are securely formed using cast metal members because, when the backhoe is used in earth excavation work, high stress due to the reactive force of excavation work is concentrated in the pivoted coupling members that are pivotably coupled at the boom support section of the running body. For this reason, significant cost savings can be assured when the pivoted coupling members of a standard boom can also be used in a two-piece boom.

Means for Solving the Problems

The boom according to an aspect of the present invention comprises a first boom having, on the base end side, pivoted coupling member pivotally coupled to a boom support section of the running body; and a second boom in which the base end side is pivotally coupled to the distal end side of the first boom and in which an arm is pivotably coupled to the distal end side; the main body portions of the first boom and the second boom being formed from the left and right side walls and the top and bottom walls; wherein the boom is characterized in that a lateral width of the main body portion of the second boom is set to be smaller in the second region of the base end side than in the first region of the distal end side; and a base end side of the second region of the second boom is inserted between the left and right side walls of the distal end of the first boom, and the second boom is pivotably coupled to the first boom so as to be capable of rotation about the lateral axis.

According to another aspect, a third region, in which the lateral width of the main body portion of the second boom continuously narrows from the first region to the second region, is preferably disposed between the first region and the second region.

According to another aspect, the lateral width of the first region of the second boom and the lateral width of the first boom are preferably formed so as to be substantially the same.

According to another aspect, the vertical widths of the left and right side walls are preferably set so that the vertical widths of the left and right side walls of the second boom are maximal in the vicinity of the border section between the second region and the third region of the second boom.

According to another aspect, the lower edge side of the second region of the second boom is preferably configured so as to enter between the left and right side walls of the distal end side of the first boom when the second boom is caused to swing downward with respect to the first boom.

The distance in the second boom from the pivot center of base side in the pivoted coupling section for the first boom to the border section is substantially ⅓ the distance from the pivot center of the base side to the pivot center of the distal end side in the pivoted coupling section for the arm.

According to this aspect, the lateral width of the main body portion of the second boom is formed so that the second region of the base end side is narrower than the first region of the distal end side, and the base end side of the second region of the second boom is inserted between the left and right side walls of the first boom and is pivotably coupled so as to rotate about the lateral axis, whereby the lateral width of the first boom can be formed to the same width as a standard boom. The pivoted coupling member of the base end side of the first boom can thereby be shared (dually used) with the pivoted coupling member of a standard boom.

KEY

Figure 1:
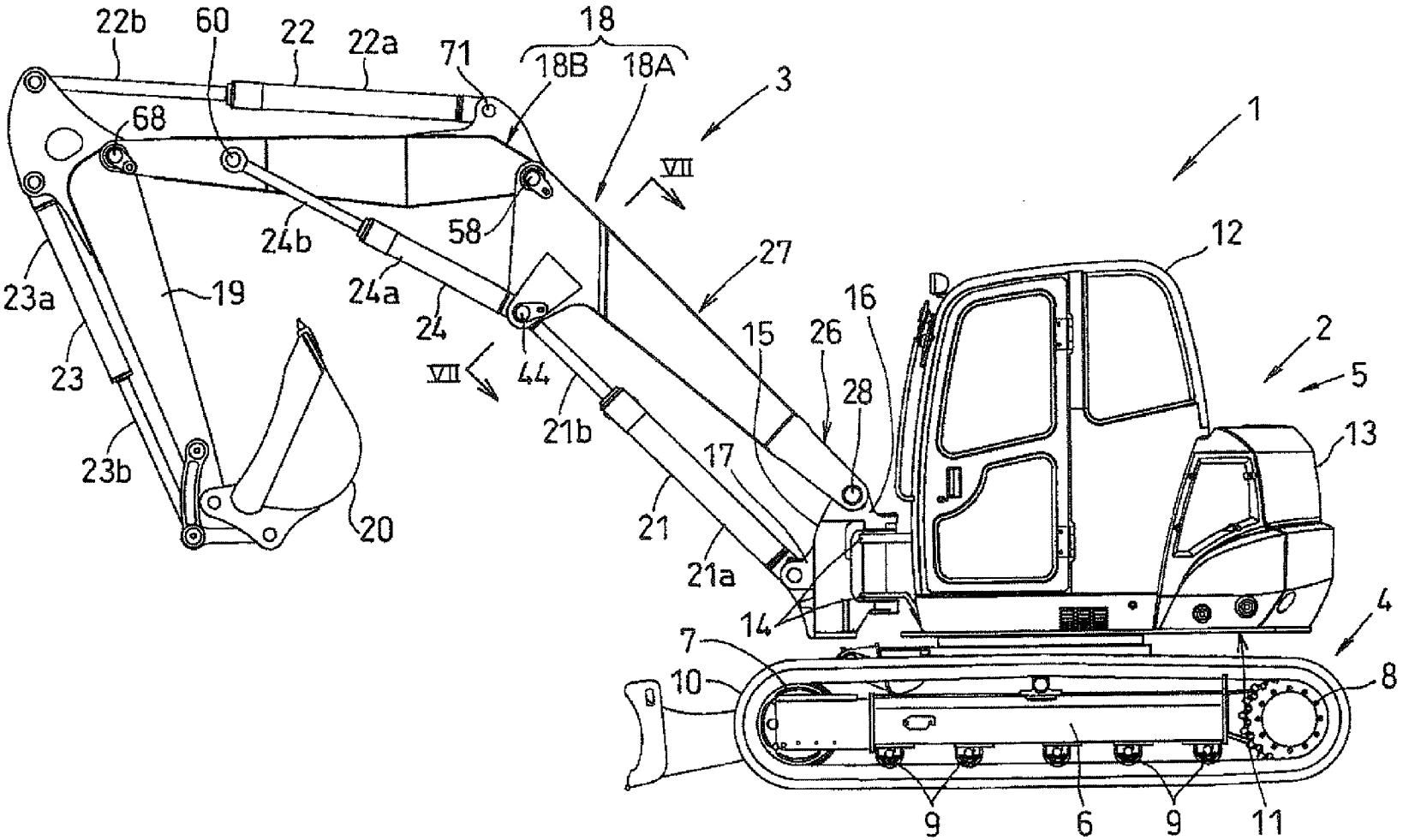
FIG. 1 is a side view of the entire backhoe.
Figure 2:
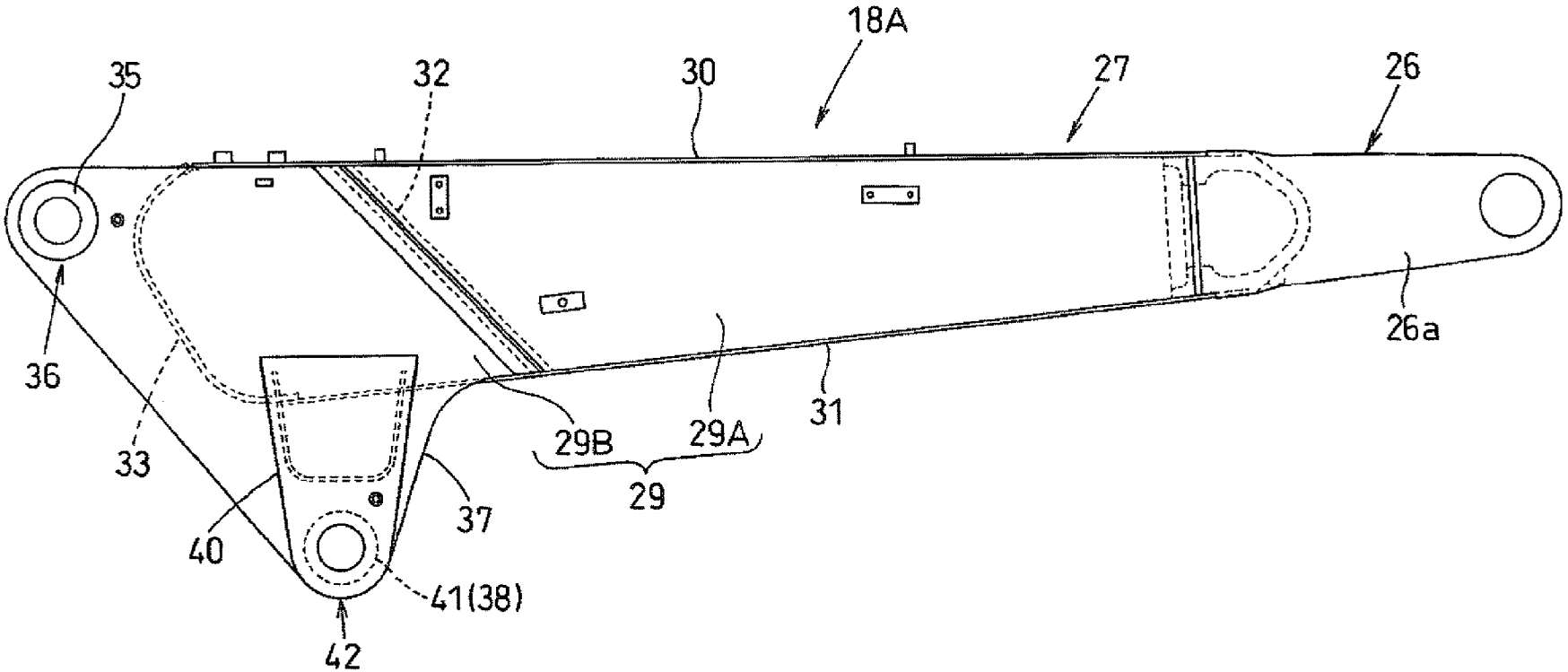
FIG. 2 is a side view of the first boom.
Figure 3:
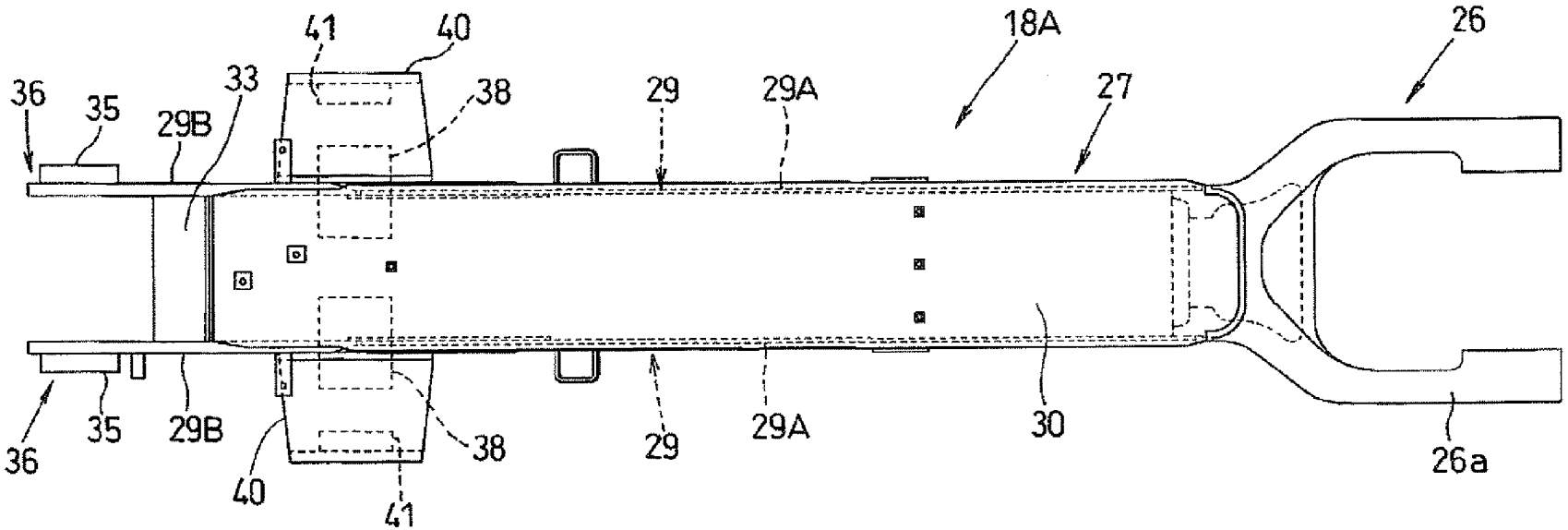
FIG. 3 is a top view of the first boom.
Figure 4:
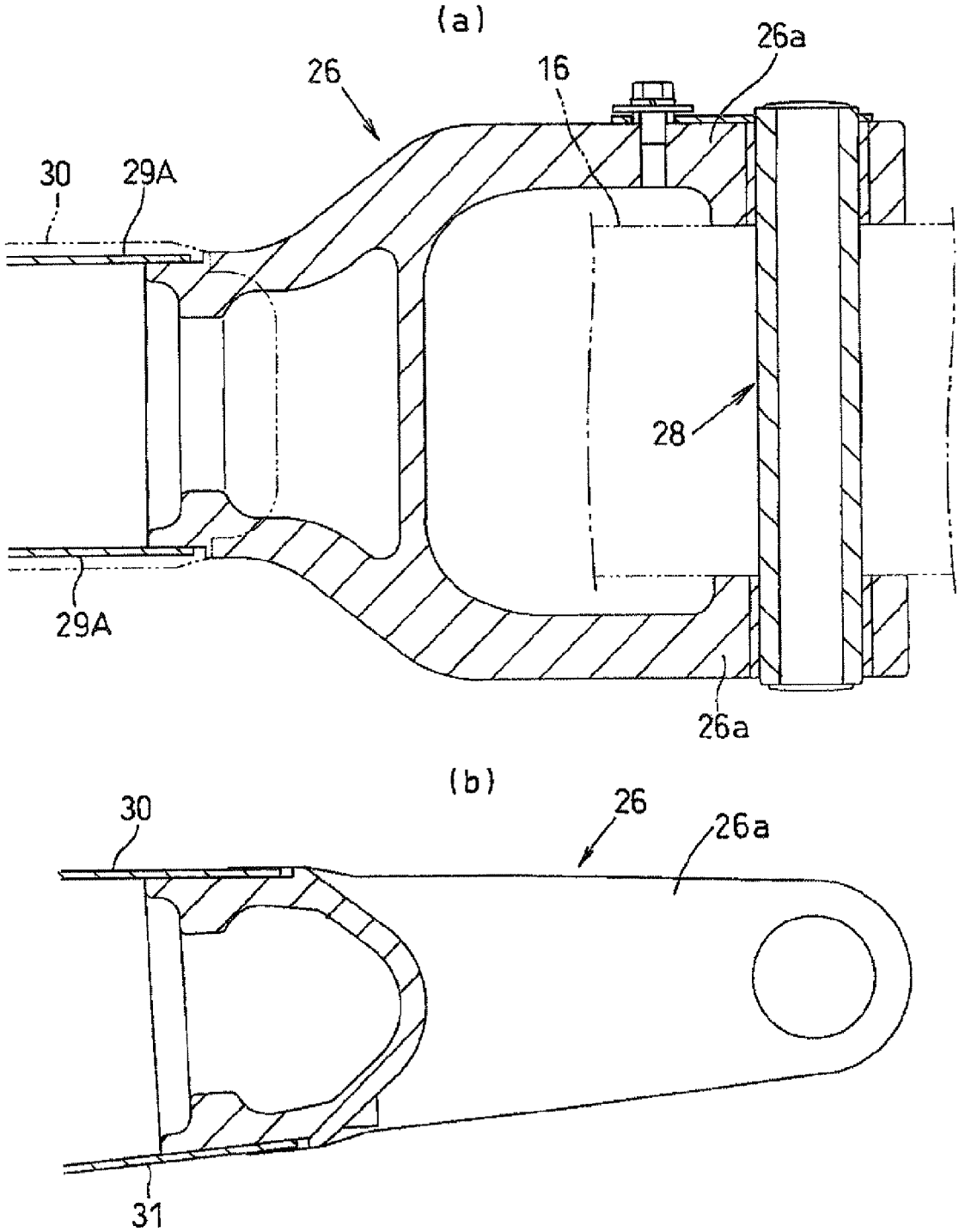
FIG. 4 is a cross-sectional view of the base end side of the first boom.

2 running body
16 boom support section
18A first boom
18B second boom
19 arm
26 pivoted coupling member
27 main body portion
29 side wall
30 upper wall
31 lower wall
51 main body portion
52 side wall
53 upper wall
54 lower wall
56 shape variable section
W4 vertical width of the side walls of the second boom
X first region
Y second region
Z third region

BEST MODE FOR CARRYING OUT THE INVENTION

Next, embodiments of the present invention will be described in detail with reference to the diagrams.

In FIG. 1, 1 is to a backhoe exemplifying a work machine. The backhoe 1 is provided with a running body 2 and an implement (an excavation implement) 3. The running body 2 is provided with a running apparatus 4 of the lower portion and a rotating body 5 of the upper portion.

The running device 4 is provided with a crawler-type running apparatus. The crawler-type running apparatus is provided with an idler 7, a sprocket 8, a plurality of rotating wheels 9, and a crawler belt 10 that is wrapped around these components, which are disposed on the left and right sides of the track frame 6. The crawler belt 10 is configured so as to travel in a circulating fashion when the sprocket 8 is rotatably driven.

The rotating body 5 is provided with a rotating platform 11 that is rotatably disposed about the axial center of a pivoted shaft in the vertical direction on the track frame 6 of the running apparatus 4, a cabin that is mounted on the rotating platform 11, and a hood 13 that covers the engine and the like that is mounted on the rear portion of the rotating platform 11.

A support bracket 14 is provided to the front portion of the rotating platform 11, and this support bracket 14 is provided with a swing bracket 15 that is rotatably mounted about the axial center in the vertical direction and that is pivoted left and right using hydraulic cylinders.

A boom support section 16 is formed on the upper portion of the swing bracket 15, and a cylinder support section 17 is formed at a midway point in the vertical direction of the front section.

The implement 3 is provided with a boom 18 whose base end is swingably and pivotably coupled to the boom support section 16 about the axial center in the lateral direction, an arm 19 that is swingably and pivotably coupled to the distal end side of the boom 18 about the axial center in the lateral direction, a bucket 20 as an attachment tool that is swingably and pivotably coupled to the distal end side of the arm 19 about the axial center in the lateral direction, a first boom cylinder 21 for causing the boom 18 to swing about the pivoted portion at the base end, an arm cylinder 22 for causing the arm 19 to swing, and a bucket cylinder 23 for causing the bucket 20 to swing.

The boom 18 is a two-piece boom provided with a first boom 18A of the base end side (rear side) and a second boom 18B of the distal end side (front side) that is swingably and pivotably coupled to the first boom 18A about the lateral axis. The implement 3 is provided with a second boom cylinder 24 for causing the second boom 18B to swing with respect to the first boom 18A, and a pair of these second boom cylinders 24 is provided on the left and right, with the cylinders arranged on both the left and right sides of the second boom 18B.

The first boom cylinder 21, arm cylinder 22, bucket cylinder 23, and second boom cylinder 24 are composed of hydraulic cylinders that are provided with cylinder tubes 21*a*, 22*a*, 23*a*, 24*a*, and piston rods 21*b*, 22*b*, 23*b*, 24*b* that retractably protrude from the cylinder tubes 21*a*, 22*a*, 23*a*, and 24*a*.

The first boom 18A has a cast pivoted coupling member 26 that is provided to the base end of the first boom 18A, and a main body portion 27 made of a metal plate that constitutes the portion from the pivoted coupling member 26 to the distal end of the first boom 18A, as shown in FIGS. 2 through 8.

In the pivoted coupling member 26, left and right pairs of pivoted portions 26*a* that extend in the shape of a fork toward the rear end are provided on the rear side. The boom support section 16 is inserted between the pivoted portions 26*a*, and the pivoted coupling member 26 is pivotably coupled to the boom support section 16 so as to be capable of rotation about the axial center in the lateral direction by way of the first boom pivot 28 that passes completely through these pivoted portions 26*a* and the boom support section 16 in a lateral direction (the first boom 18A is swingably supported by the boom support section 16 in the vertical direction about the axial center of the first boom pivot 28).

The main body portion 27 of the first boom 18A is formed from left and right side walls 29 and top and bottom walls 30 and 31. The front end of the pivoted coupling member 26 is inserted into the base end side of the main body portion 27, and the front end of the pivoted coupling member 26 is fastened by welding to the base end side of the first boom 18A.

The left and right side walls 29 of the first boom 18A are provided with two members, which are a main plate 29A as a component of a base end side and an intermediate section, and a distal end-side plate 29B as a component of a distal end side. The main plate 29A and distal end-side plate 29B are brought together in the lengthwise direction of the first boom 18A and joined by welding.

The joined section of the main plate 29A and distal end plate 29B is formed diagonally in the lengthwise direction of the boom so as to transition to the base end side in progression from the upper wall 30 to the lower wall 31. A patch plate 32 is provided to the inner side of the joined section between the main plate 29A and distal end-side plate 29B.

The main plate 29A and distal end-side plate 29B are disposed so that the inside surfaces are flush with each other, and the first boom 18A is formed so that the dimension (opposing distance) between the left and right side walls 29 of the main body portion 27 of the first boom 18A is uniform from the base end to the distal end.

The distal end-side plate 29B is composed of a plate material that is thicker than the main plate 29A.

The plate thickness of the distal end-side plate 29B and main plate 29A are different in the present embodiment, and the main plate 29A and distal end-side plate 29B are disposed so that inner surfaces are flush with each other. For this reason, the lateral width of the first boom 18A (referred to as the distance from the outer surface of one side wall 29 to the outer surface of the other side wall 29) is formed with substantially the same width from the distal end side to the base end side, although the lateral width of the distal end-side plate 29B and lateral width of main plate 29A will differ slightly.

The lateral width of the distal end-side plate 29B of the first boom 18A and the lateral width main plate 29A of the first boom 18A can be formed so as to be the same width. The lateral width of the main plate 29A of the first boom 18A has the same width as the lateral width of a standard boom that is integrally formed from the base end side to the distal end side.

An upper wall 30 is superimposed on the upper end of the left and right side walls 29 and welded and fixed to the side walls 29. A lower wall 31 is superimposed on the lower end of the left and right side walls 29 in the portion on the rear side of the joined section between the main plate 29A and the distal end-side plate 29B, and is welded and fixed to the side walls 29. The front portion of the lower wall 31 is narrower on the front side of the joined section between the main plate 29A and distal end-side plate 29B, is inserted between the left and right distal end-side plates 29B, and is welded and fixed to the distal end-side plates 29B.

The front sides of the upper wall 30 and the lower wall 31 are coupled by means of a coupler plate 33 that is disposed between the left and right distal end-side plates 29B.

The coupler plate 33 is formed in the shape of an inverted C, with an opening in the rear direction as viewed from the side. The upper end of the coupler plate 33 is brought together with, and is welded to, the front side of the upper wall 30, and a patch plate 34 is provided to the inner side (underside) joined section. The lower end side of the coupler plate 33 is superimposed and welded onto the front end side of the lower wall 31.

The front end sides of the left and right distal end-side plates 29B extend further to the front side than do the upper wall 30 and the coupler plate 33. A boss 35 is fastened to the outer surface side of the section that extends to the front side, and the sections to which the boss 35 is fastened are the second boom pivoted sections 36 in which the base end side of the second boom 18B is pivotably coupled. The base end side of the second boom 18B is inserted and pivotably coupled between the second boom pivoted sections 36.

The lower section of the left and right distal end-side plates 29B extends further to the lower side than does the lower wall 31, and a boss 38 is provided so as to pass completely through to the lower end side of the lower section extended portion 37 that extends further to the lower side than does the lower wall 31. The section where the boss 38 is provided is the first cylinder pivoted portion 39.

A bracket plate 40 is disposed on the outer side in the lateral direction of the lower section extended portion 37 of the left and right distal end-side plates 29B.

The upper end portions of the left and right bracket plates 40 are welded and fixed to the outer surface of the distal end-side plate 29B, and the upper side is formed at an incline so as to slope outward in the lateral direction in progression downward. The lower side faces the lower section extended portion 37 of the left and right distal end-side plates 29B. A boss 41 that is disposed concentrically with the boss 38 of the first cylinder pivoted portion 39 is provided to the lower side of the left and right bracket plates 40, and the section where the boss 41 is disposed is the second cylinder pivoted portion 42.

A U-shaped coupler plate 43 is disposed between the upper side of the bracket plate 40 and the distal end-side plate 29B on the same side in a lateral direction, and the left and right bracket plates 40 are coupled to the left and right distal end-side plates 29B via the coupler plate 43.

A cylinder pivot 44 is inserted through the bosses 38 and 41 of the left and right first cylinder pivoted portions 39 and the left and right second cylinder pivoted portions 42, and through the lower portion of the lower section extended portions 37 the bracket plate 40 of the left and right distal end-side plates 29B. A piston rod 21*b* of the first boom cylinder 21 is pivotably coupled between the first cylinder pivoted portions 39 of the cylinder pivot 44. The bottom side end section of the cylinder tube 21*a* of the first boom cylinder 21 is pivotably coupled to the cylinder support section 17 of the swing bracket 15.

The bottom side end section of the cylinder tube 24*a* of the second boom cylinder 24 is pivotably coupled between the first cylinder pivoted section 39 and the second cylinder pivoted section 42 on the same side in the lateral direction of the cylinder pivot 44.

The main body portion 51 of the second boom 18B is formed from the left and right side walls 52 and the top and bottom walls 53 and 54 in the same manner as the first boom 18A, as shown in FIGS. 9 to 17.

In the same manner as the first boom 18A, the side walls 52 of the second boom 18B are mainly composed of two members, which are a main plate 52A that is composed of a base end side and an intermediate section, and a distal end-side plate 52B that is composed of a distal end side. The main plate 52A and distal end-side plate 52B are brought together in the lengthwise direction of the second boom 18B and joined by welding, and a patch plate 55 is provided to the inner side of the joined section of the main plate 52A and distal end-side plate 52B. The distal end-side plate 52B is composed of a plate material that is thicker than the main plate 52A.

The joined section of the main plate 52A and the distal end-side plate 52B of the second boom 18B are formed in the orthogonal direction with respect to an upper wall 53.

The main body portion 51 of the second boom 18B has a first region of the distal end side, a second region of the base end side, and a third region between the first and second regions. The lateral width of the main body portion 51 of the second boom 18B (referred to as the distance between the outer surface of one side wall 52 to the outer surface of the other side wall 52) is formed so that the lateral width W2 of the second region Y is narrower than the lateral width W1 of the first region X. The lateral width W3 of the third region Z between the first region X and second region Y is formed in a taper shape that is progressively narrower from the first region X to the second region Y (see FIG. 15).

The first region X of the second boom 18B is composed of the distal end-side plate 52B, and the third region Z (taper location) and second region Y are composed of the main plate 52A. The lateral width WI of the first region X is formed to substantially the same width as the lateral width of the first boom 18A (in the present embodiment, the lateral width WI of the first region X of the second boom 18B differs slightly from the lateral width of the first boom 18A, but these may be exactly the same width).

The dimension between the left and right side walls 52 of the first region X of the second boom 18B (opposing distance) is formed with the same dimension as that between the left and right side walls 29 of the first boom 18A, and the plate thickness of the main plate 52A of the second boom 18B is the same thickness as the main plate 29A of the first boom 18A. The plate thickness of the distal end-side plate 52B of the second boom 18 is somewhat greater than the plate thickness of the distal end-side plate 29B of the first boom 18A.

Figure 9:
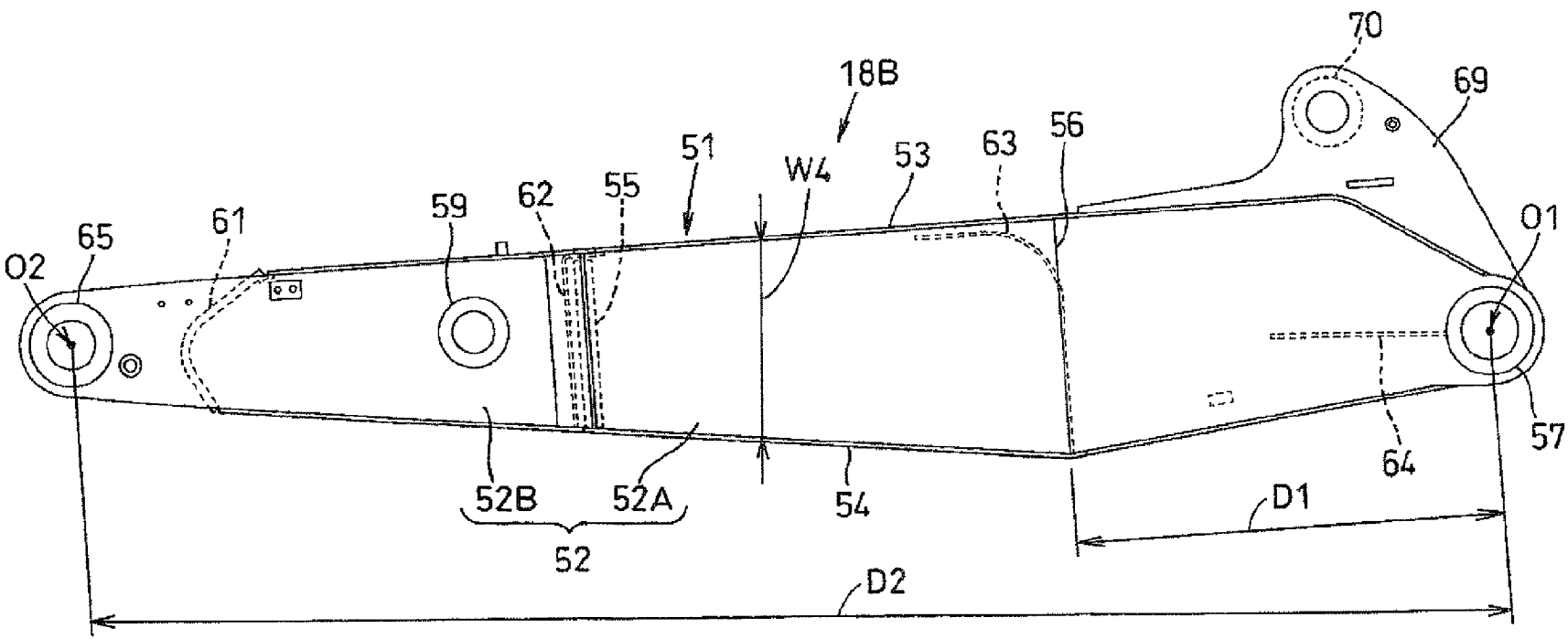
FIG. 9 is a side view of the second boom.
Figure 10:
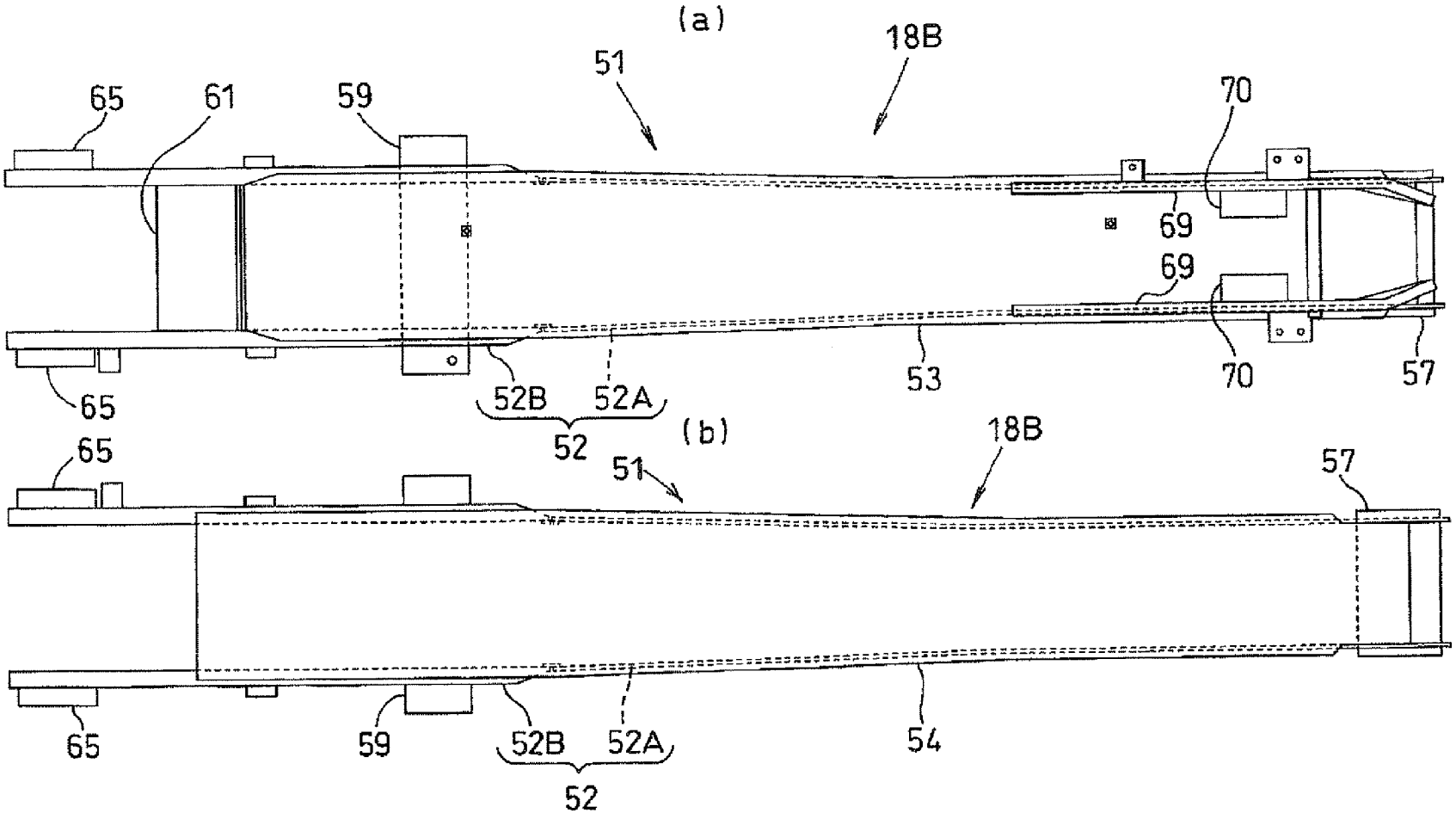
FIG. 10 is a top view and side view of the second boom.
Figure 11:
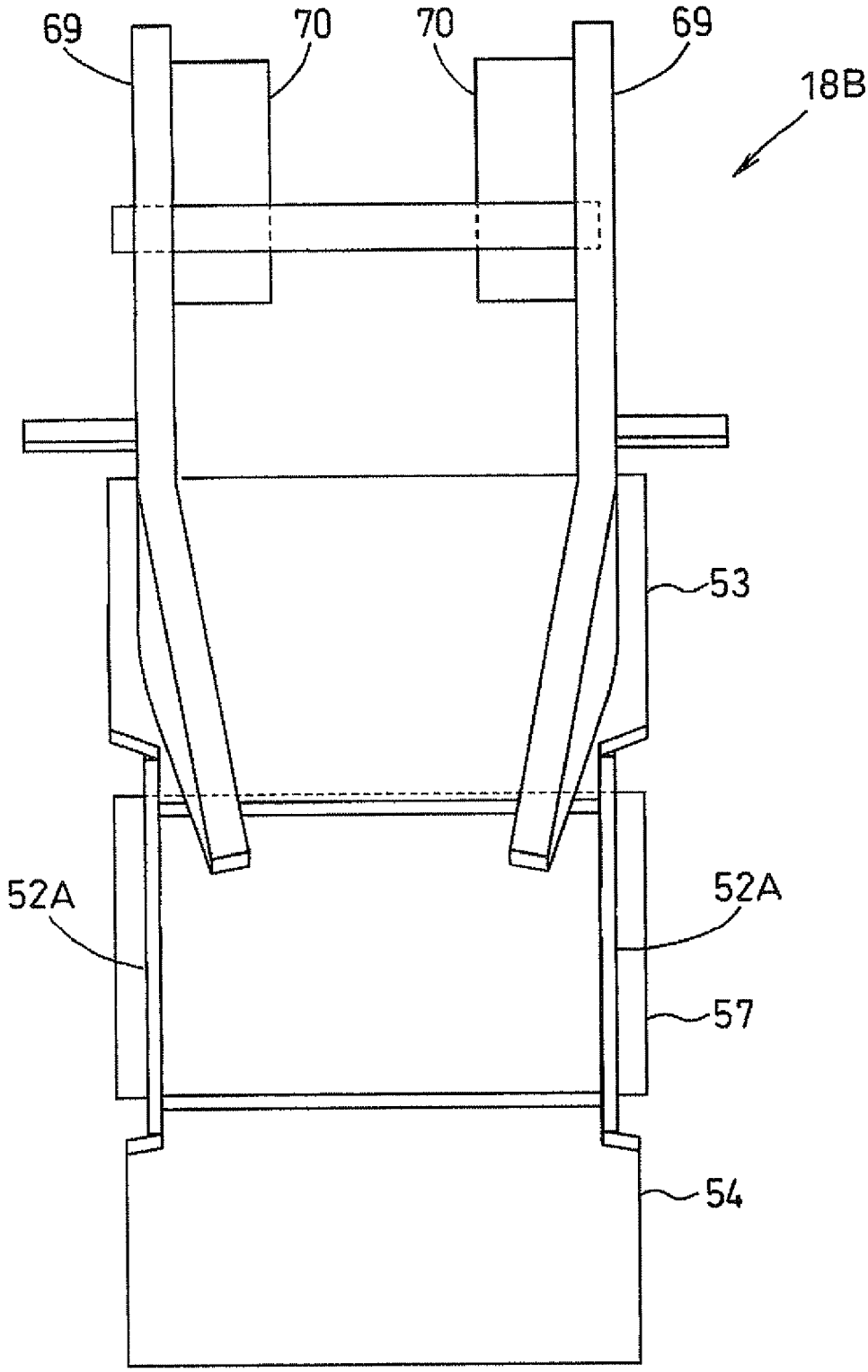
FIG. 11 is a rear view of the second boom.
Figure 12:
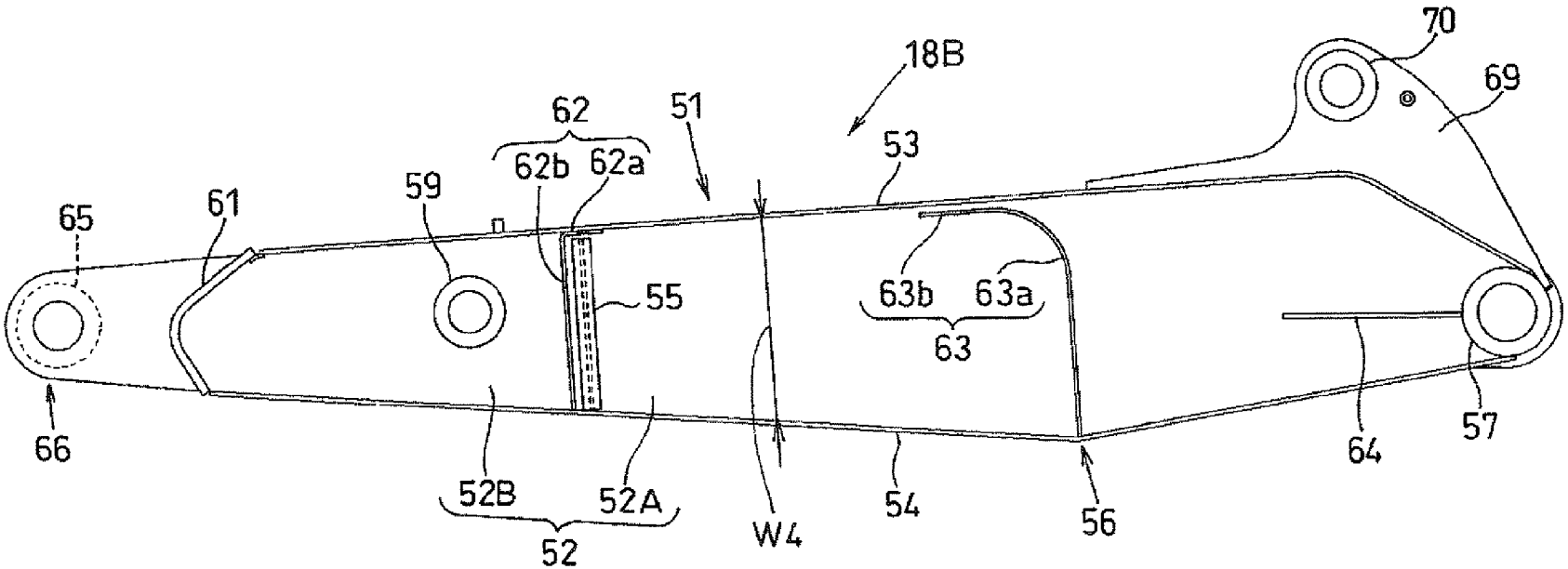
FIG. 12 is a lateral cross-sectional view of the second boom.

As shown in FIGS. 9 and 12, in the second boom 18, the vertical width W4 of the side walls 52 of the second boom 18B becomes progressively greater from the distal end side in the rearward direction, and constitutes the maximum vertical width in the curved section 56 of the main plate 52A, which is the boundary between the second region Y and third region Z of the second boom 18B (the shape variable section in which the shape varies so that the lateral width of the second boom 18B becomes greater from the base end side to the distal end side). The vertical width W4 of the left and right side walls 52 of the intermediate section in the lengthwise direction of the second boom 18B is made considerable so that the width progressively narrows from the curved section 56 of the main plate 52A to the base end side.

The vertical width W4 of the left and right side walls 52 can be the maximum width in the vicinity of the curved section 56 on the main plate 52A or in a fixed range forward or rearward thereof.

As described above, when the lateral width W2 of the second region Y of the second boom 18B is made less than the lateral width W1 of the first region X of the second boom 18B, strength is reduced in the border section 56 of the second region Y and third region Z whose shape varies so that the lateral width of the second boom 18B increases from the base end side to the distal end side, and stress will concentrate in the section 56. In view of this situation, in the present embodiment, the vertical width of the left and right side walls W4 of the intermediate section in the lengthwise direction of the second boom 18B is increased so that the vertical width W4 of the left and right side walls 52 of the second boom 18B is at a maximum in the border section 56 (or the vicinity thereof), where the shape varies so that the lateral width of the second boom 18B widens from the base end side to the distal end side. The strength of the second boom can thereby be assured.

Figure 5:
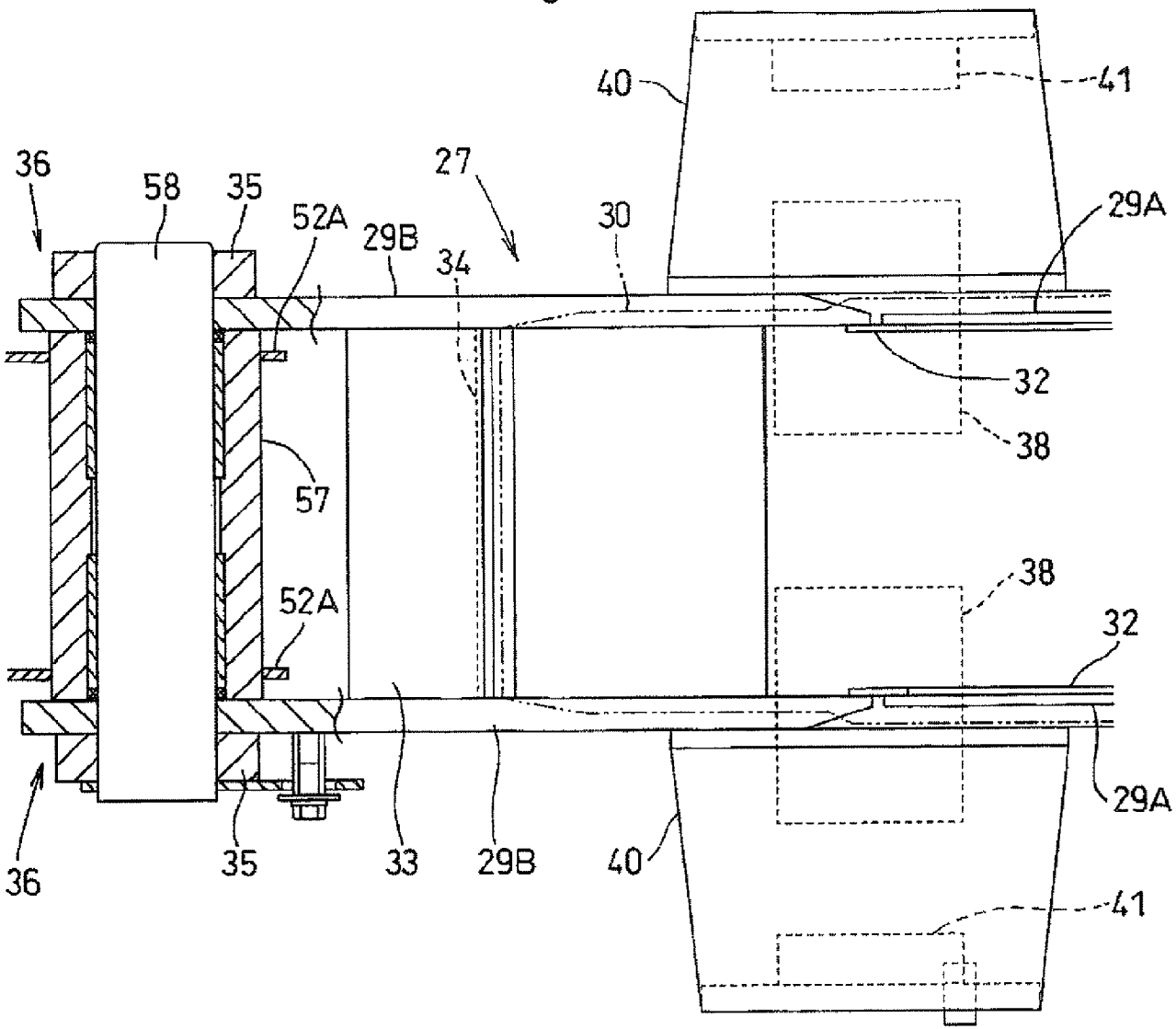
FIG. 5 is a top partial cross-sectional view of the distal end of the first boom.
Figure 6:
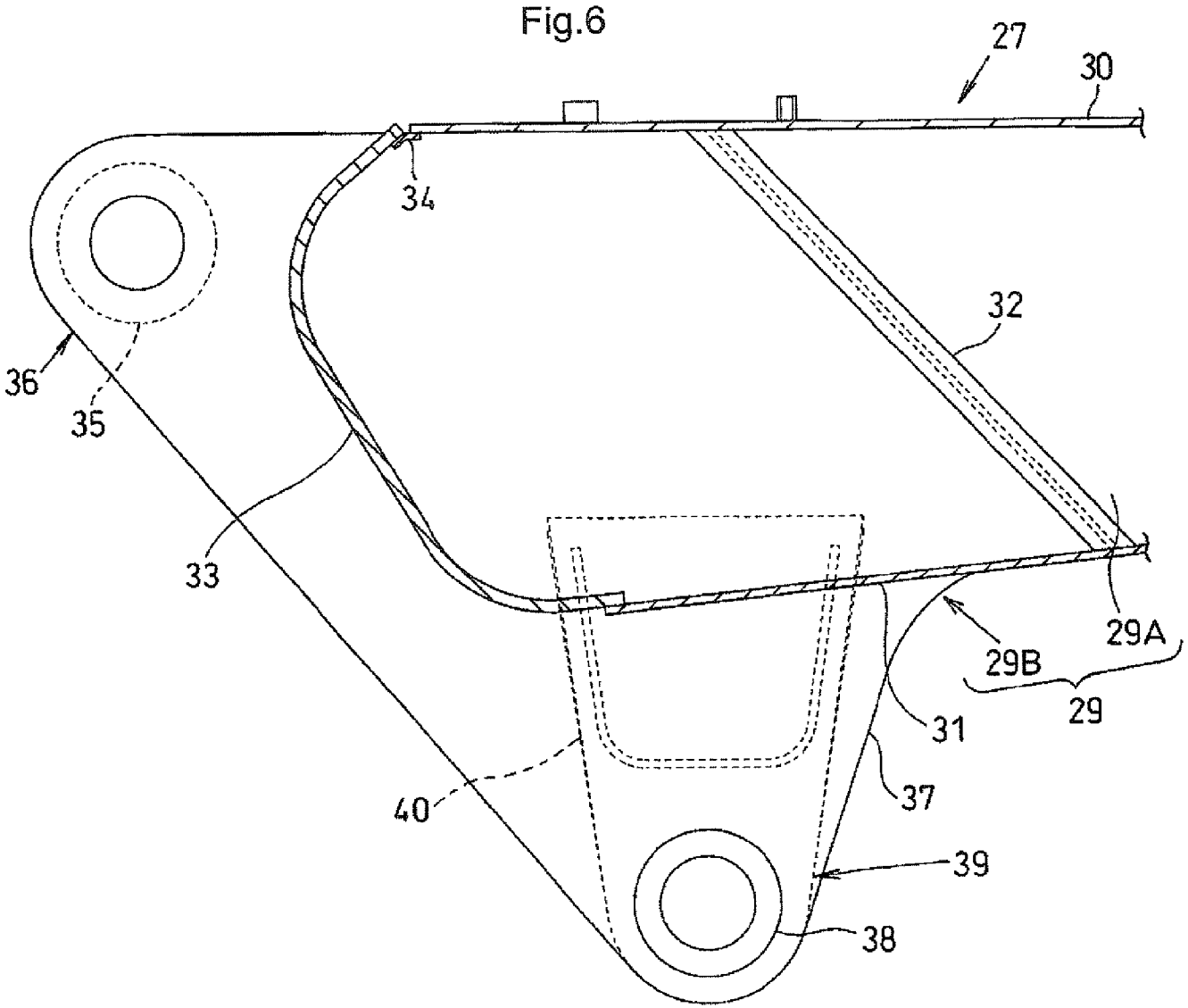
FIG. 6 is a lateral cross-sectional view of the distal end of the first boom.
Figure 7:
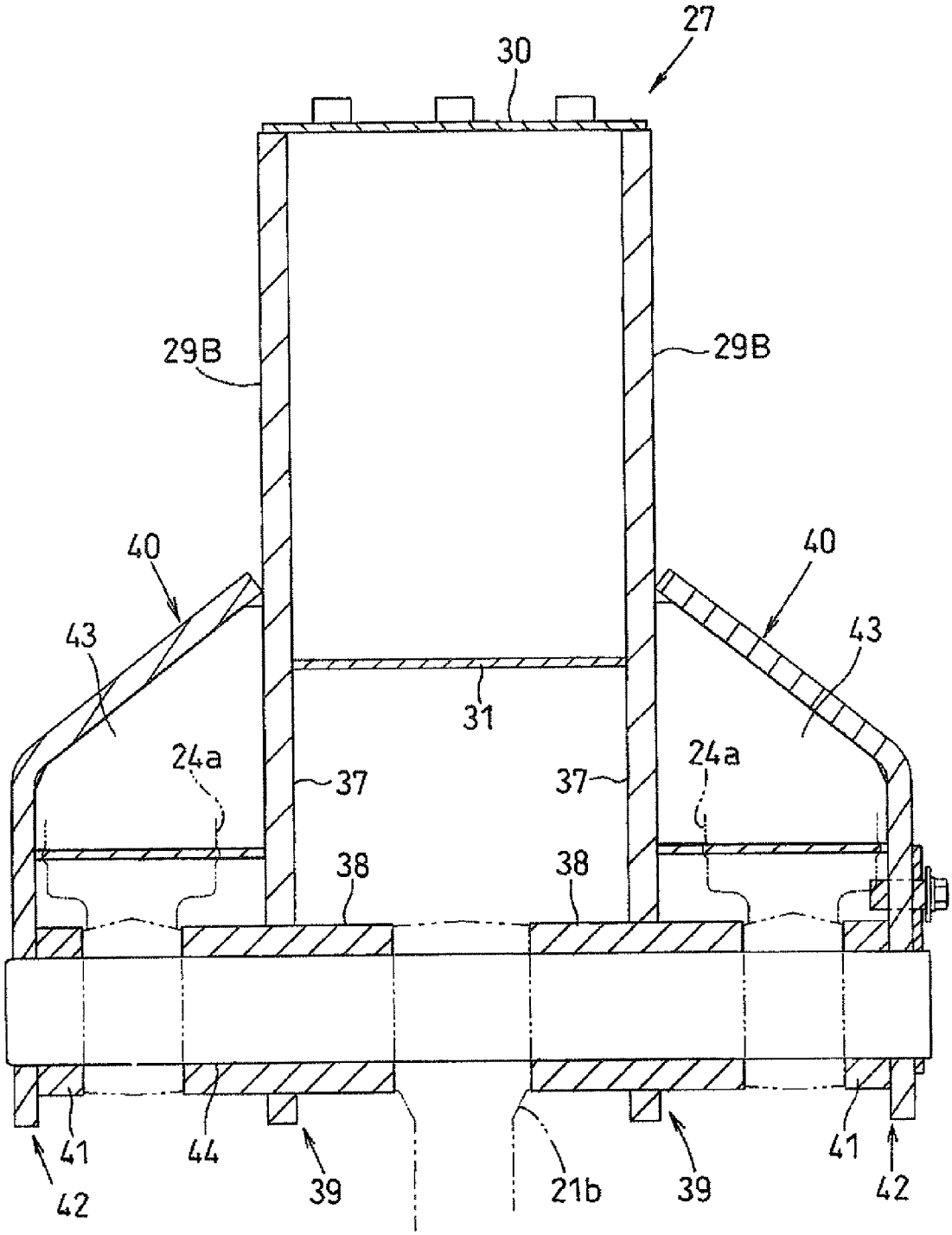
FIG. 7 is a cross-sectional view along VII-VII of FIG. 1.
Figure 8:
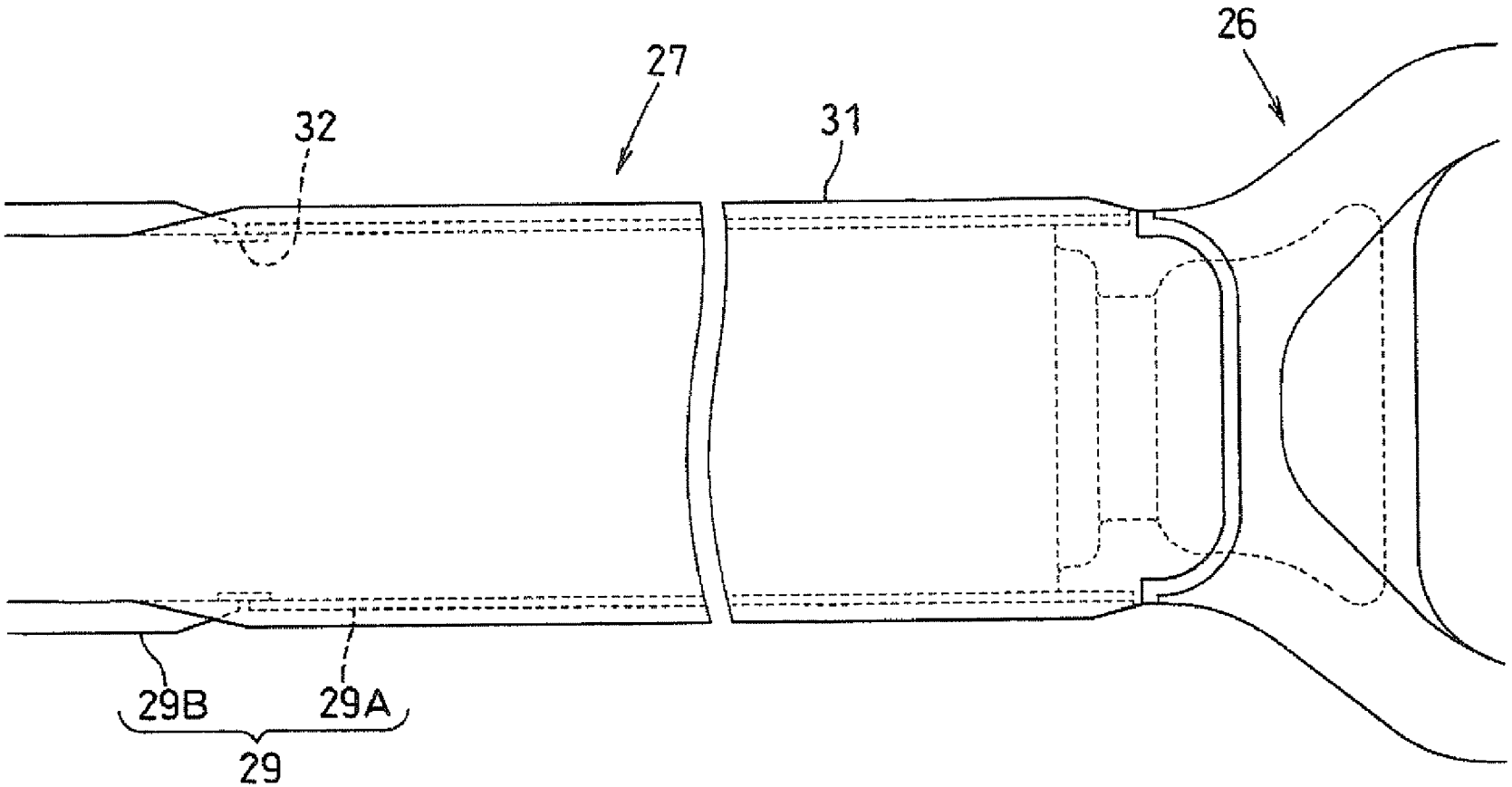
FIG. 8 is a bottom view of the base end side of the first boom.

A boss 57 having an axial center in the lateral direction passes completely through the left and right side walls 52 in the rear end side of the left and right side walls 52, and is welded and fixed to the side walls 52. As shown in FIG. 5, the boss 57 is inserted between the second boom pivoted portions 36; and a second boom pivot 58 is inserted through the boss 57, the boss 35 of the second boom pivot pivoted portions 36, and the distal end plate 29B of the first boom 18A, whereby the base end side of the second boom 18B is pivotably coupled to the distal base end of the first boom 18A so as to be capable of rotation about the axial center in a lateral direction.

A boss 59 passes completely through in the lateral direction toward the rear sides of the left and right distal end-side plates 52B of the second boom 18B. A cylinder pivot 60 is inserted through the boss 59 so as to protrude to the left and right sides, and the distal end side of a piston rod 24*b* of the second boom cylinder 24 is pivotably coupled to both the left and right sides of the cylinder pivot 60. The left and right second boom cylinders 24 are telescoped, whereby the second boom 18B is configured to swing vertically about the second boom pivot 58 with respect to the first boom 18A.

The upper wall 53 is superimposed on the upper ends of the left and right side walls 52, the lower wall 54 is superimposed on the lower end of the left and right side walls 52, and both are welded and fixed to the side walls 52.

The front end sides of the upper wall 53 and lower wall 54 are coupled using the coupling plate 61 disposed between the left and right distal end-side plates 52B. The rear end sides of the upper wall 53 and lower wall 54 are made to be narrow, are inserted between the left and right main plates 52A, and are joined to the boss 57 on the rear end of the second boom 18B.

First to third reinforcement plates 62, 63, and 64 provided so as to couple the left and right side walls 52 are disposed between the left and right side walls 52 of the second boom 18B.

The first reinforcement plate 62 is disposed on the joined section of the main plate 52A and the distal end-side plate 52B, and is formed in the shape of an L from an upper wall section 62*a* that is disposed across the main plate 52A and the distal end-side plates 52B, and from a perpendicular wall section 62*b* that extends downward from the front end side of the upper wall section 62*a* and that is positioned on the front side of a patch plate 55.

The second reinforcement plate 63 is disposed on the rear side of the third region Z of the second boom 18B, and is formed in the shape of an L from the perpendicular wall section 63*a* that is positioned so that the front surface conforms with the curved section 56 of the main plate 52A, and from the upper wall section 63*b* that extends from the upper end of the perpendicular wall section 63*a* to the front side.

The third reinforcement plate 64 is disposed on the rear end side of the second boom 18B, is composed of a flat plate material in which the plate surfaces face up and down, and is joined by the rear end to the boss 57 of the rear end side of the second boom 18B.

The front sides of the left and right distal end-side plates 52B extend from the coupler plate 61 toward the front side, and a boss 65 is fastened to the external surface side in the lateral direction of the extended portion. The section where the boss 65 is fastened is an arm pivoted section 66 about which the arm 19 pivots.

Figure 13:
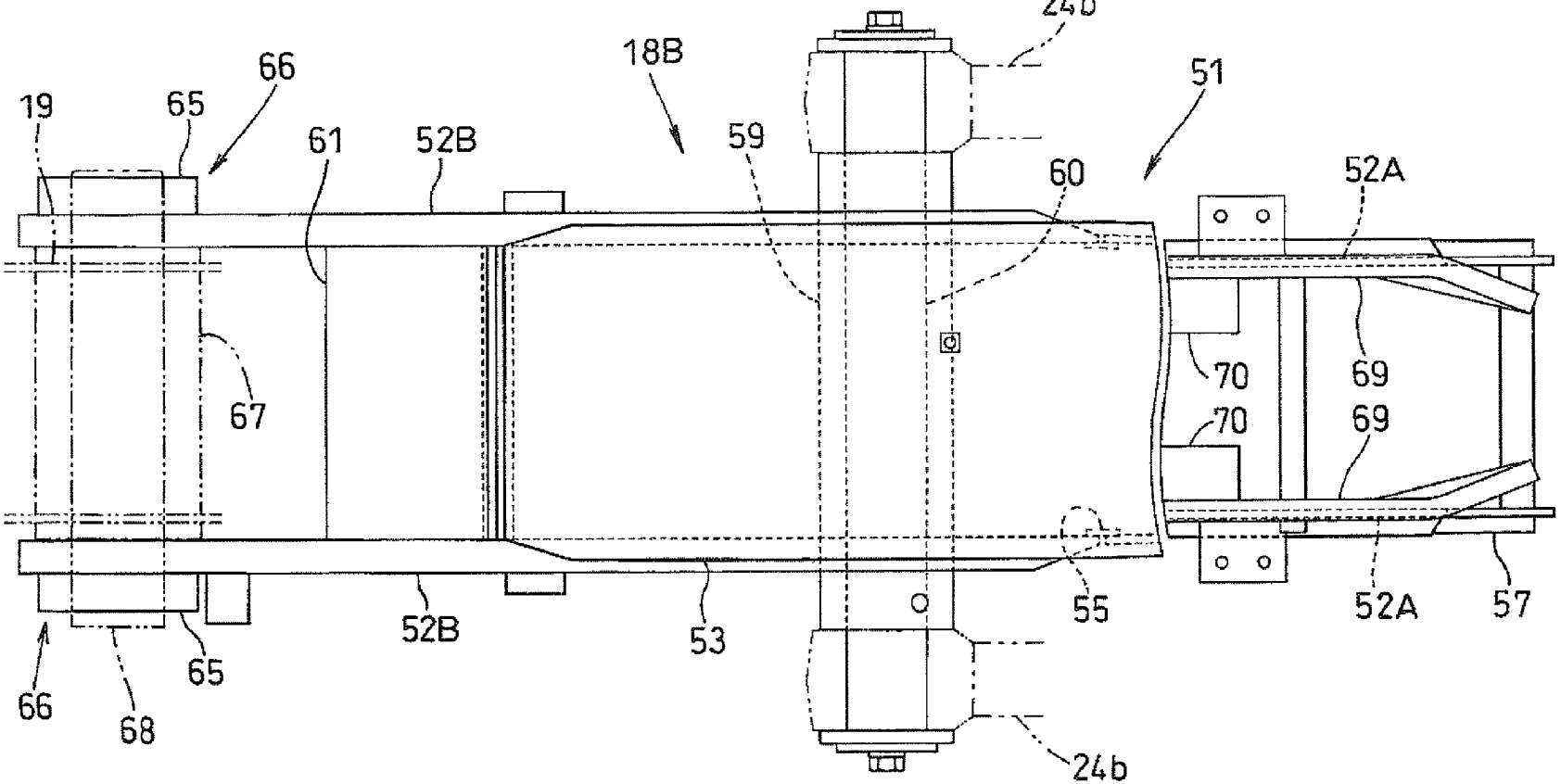
FIG. 13 is a partial top view of the second boom.
Figure 14:
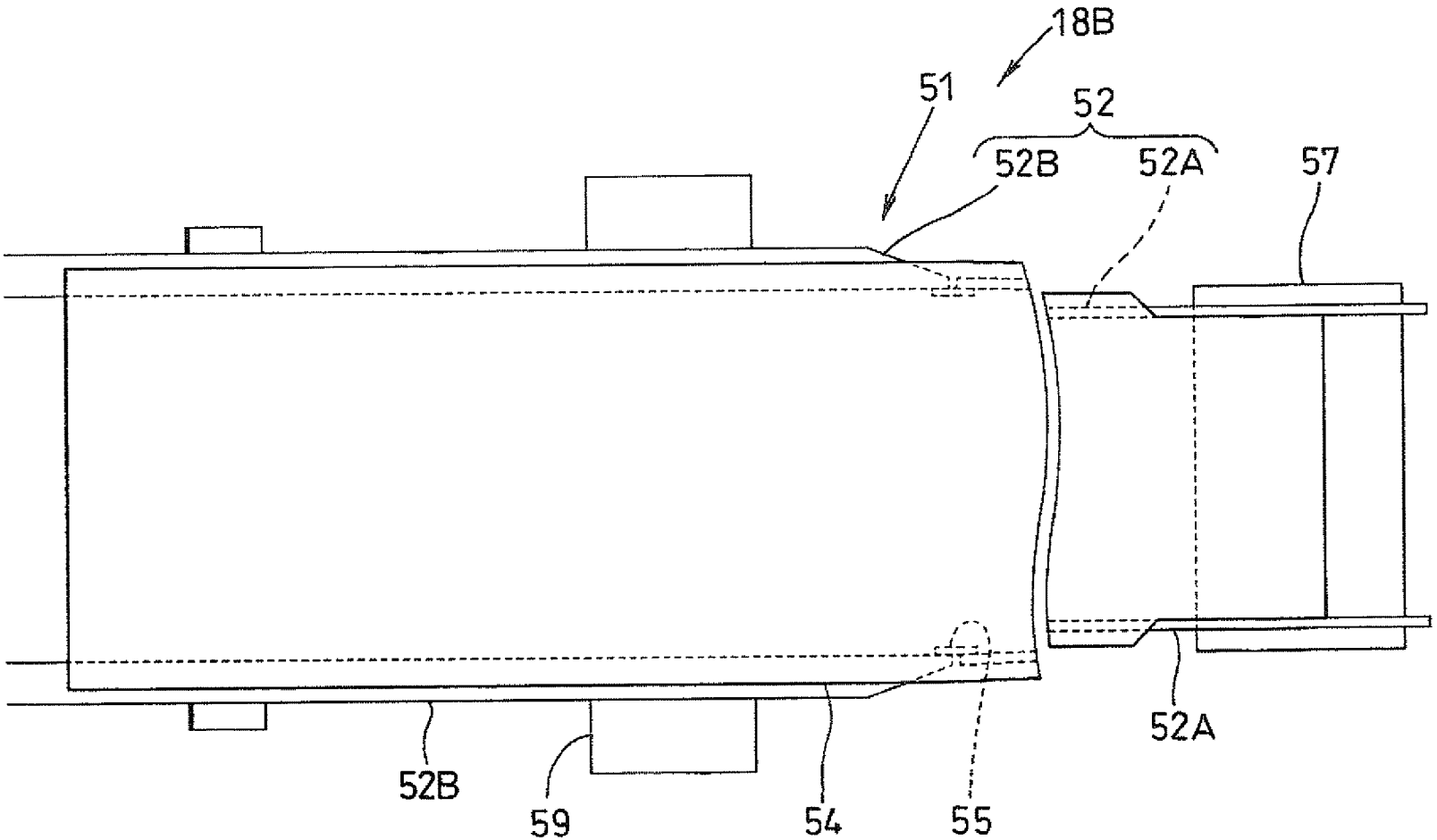
FIG. 14 is a partial bottom view of the second boom.
Figure 15:
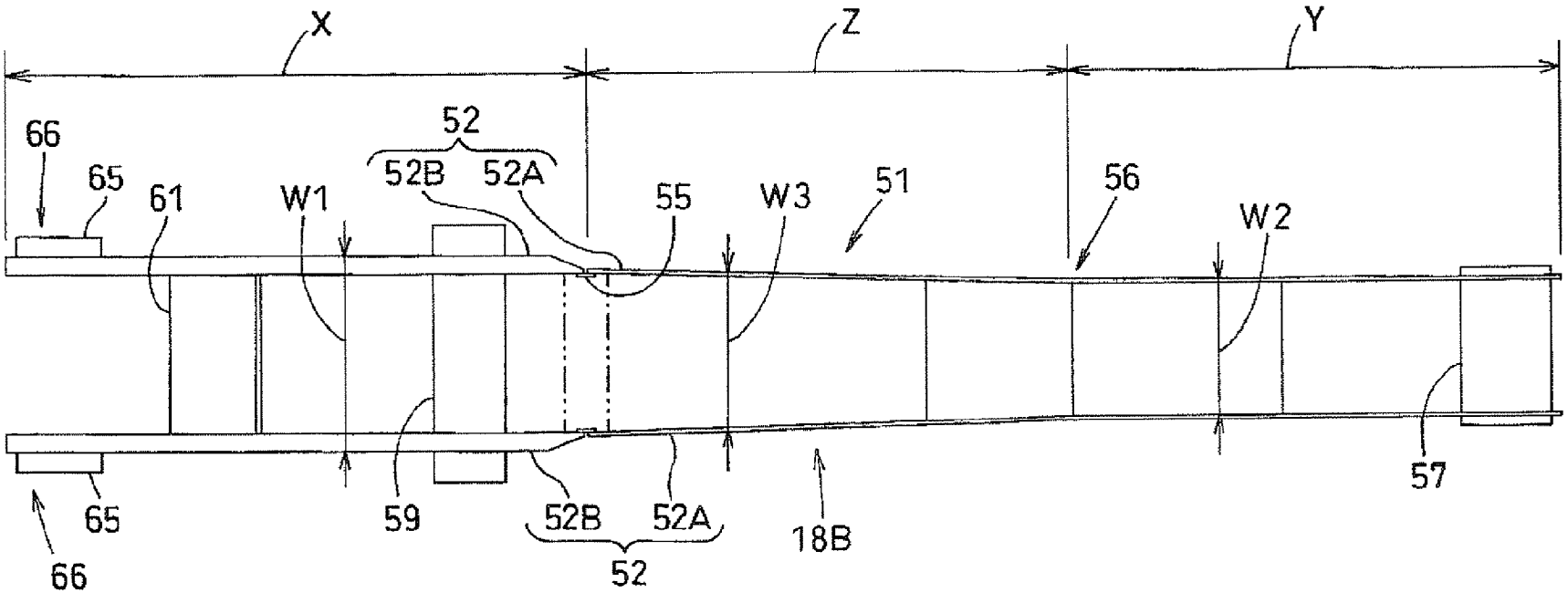
FIG. 15 is top view with the upper wall of the second boom omitted.
Figure 16:
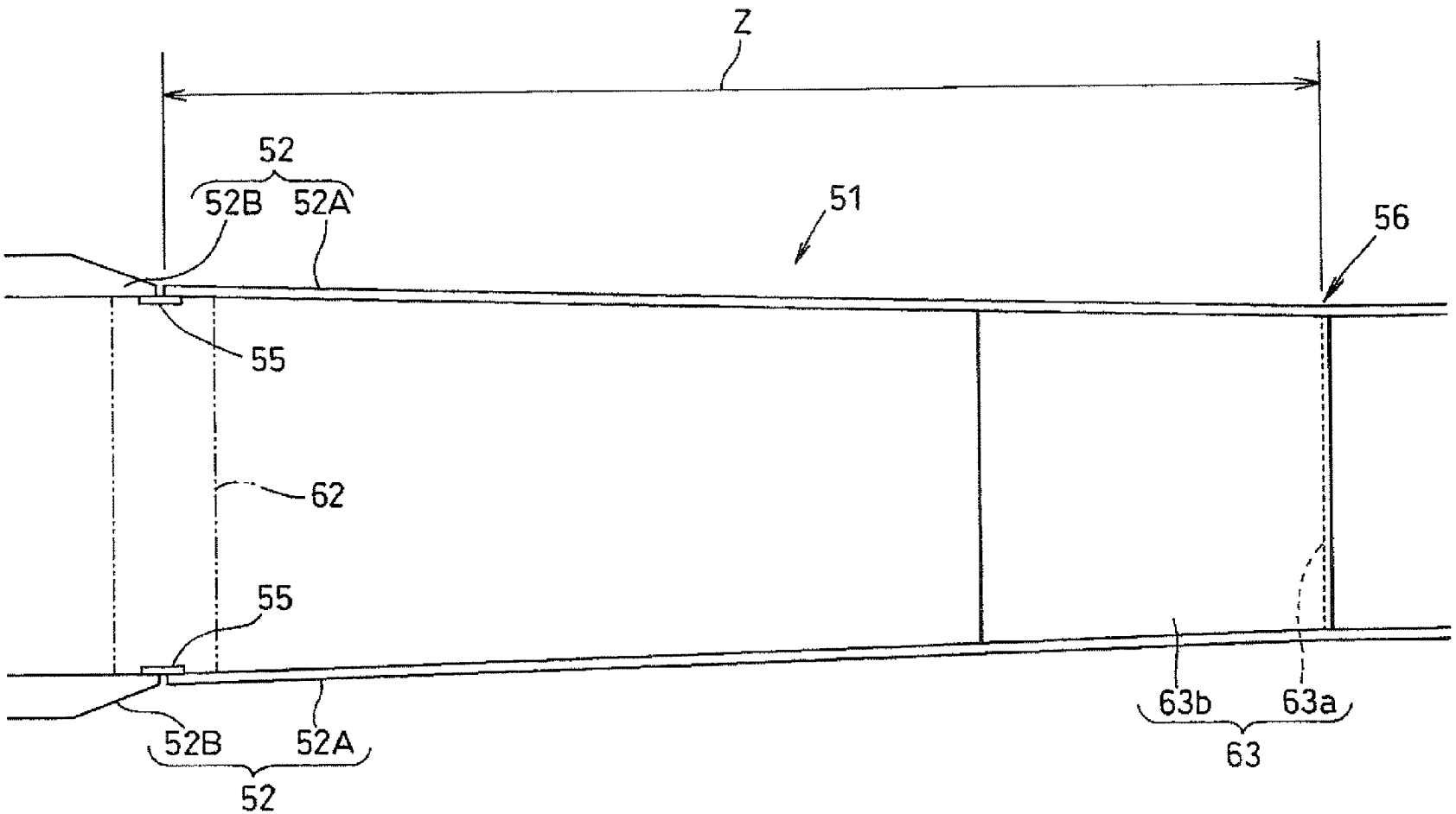
FIG. 16 is a top view, with the upper wall of the third region of the second boom omitted.
Figure 17:
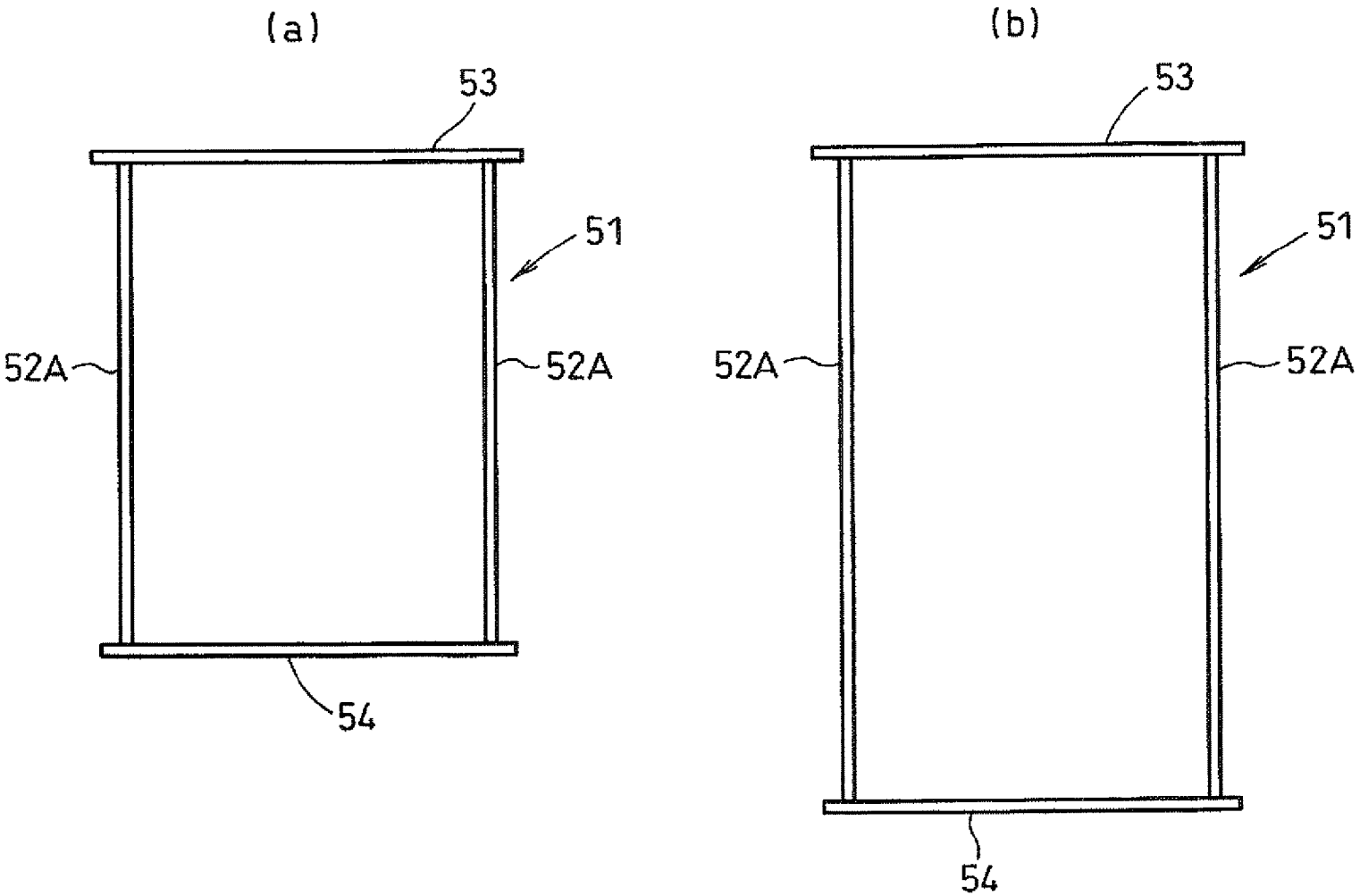
FIG. 17 is a diagram showing the third region of the second boom.

As shown in FIG. 13, a boss 67 that is provided to the base end side of the arm 19 is inserted between the left and right arm pivoted sections 66; and an arm pivot 68 is inserted through the boss 65 of the arm pivoted section 66, the distal end-side plate 52B, and the boss 67 of the base end side of the arm 19, whereby the base end side of the arm 19 is pivotably coupled to the distal end side of the second boom 18B so as to be capable of rotation about the axial center in a lateral direction.

Left and right pairs of bracket plates 69 are disposed on the upper wall 53 of the base end side of the second boom 18B, a boss 70 is fixed to the opposing surfaces of the left and right bracket plates 69, and the bottom side end section of the cylinder tube 22*a* of the arm cylinder 22 is pivotably coupled by way of the pivot 71 that is inserted through the left and right bracket plates 69 and the left and right bosses 70.

The distal end side of the piston rod 22*b* of the arm cylinder 22 is pivotably coupled to the base end side of the arm 19.

As shown in FIG. 1, in the backhoe 1 of this configuration, the lower end side of the second region Y, which is the location between the border section 56 and the base end of the second boom 18B, is configured so as to enter between the left and right side walls 29 of the distal end side of the first boom

Figure 18:
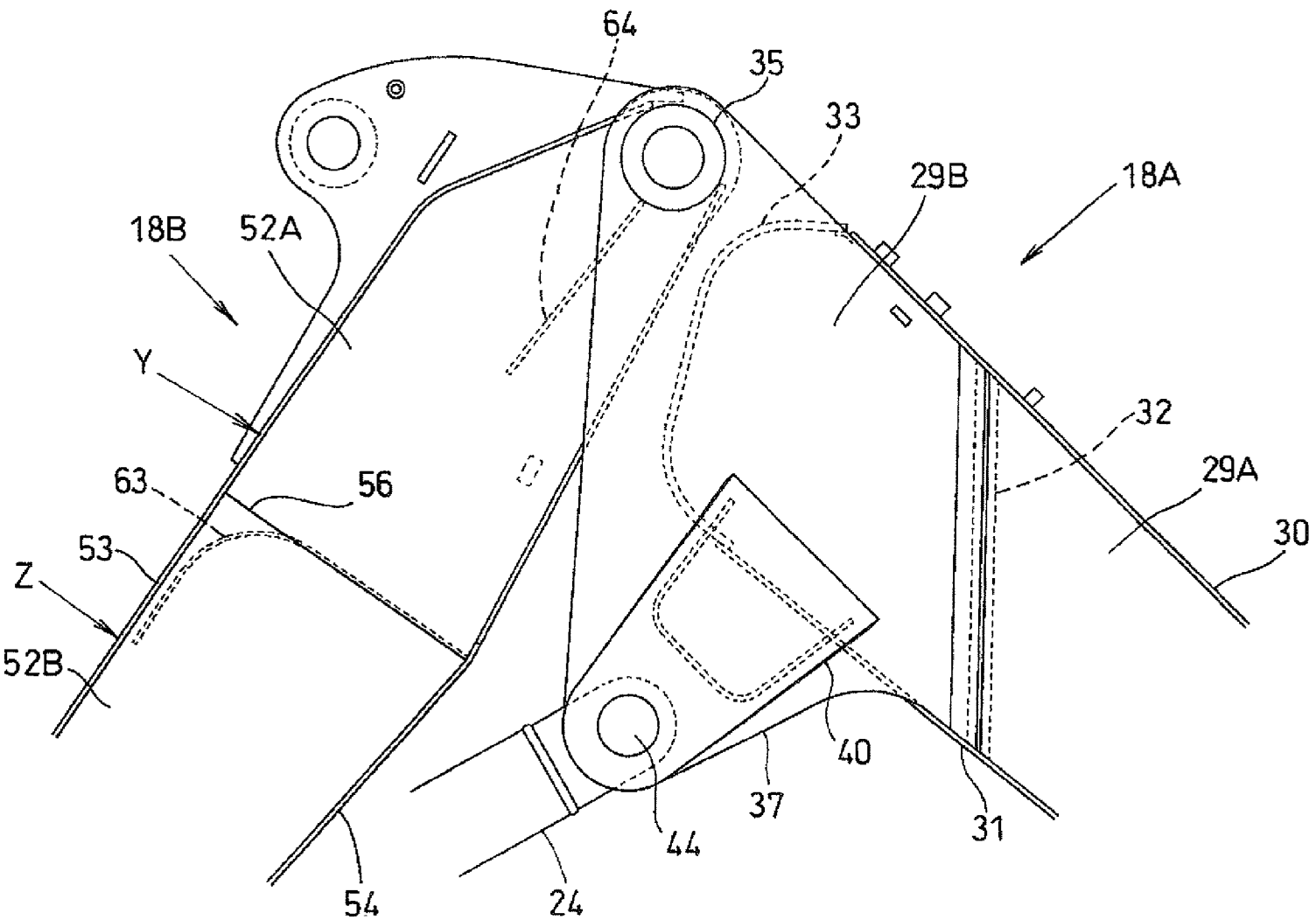
FIG. 18 is a side view showing the state in which the second boom is caused to swing downward with respect to the first boom.

18A when the second boom cylinder 24 is contracted from the fullest extension of the second boom cylinder 24, and the second boom 18B is made to swing downward in relation to the first boom 18A. As shown in FIG. 18, with the second boom cylinder 24 fully contracted, the second region Y enters between the left and right side walls 29 of the distal end side of the first boom 18A as far as the intermediate section in the lengthwise direction of the boom (no limitation is imposed by the state exemplified in the diagram, and the configuration may be one in which [the second region] enters even further from the state exemplified in the diagram).

On the other hand, in the boom 18 in which the lateral width of the main body portion 51 of the second boom 18B is formed so that the second region Y is narrower than the first region X, and the second region Y is inserted and pivotably coupled between the left and right side walls 29 of the distal end of the first boom 18A, if the second region Y of the second boom 18B in the lengthwise direction of the boom is excessively short, the vertical swing range of the second boom 18B cannot be made large in relation to the first boom 18A when consideration is given to preventing the vicinity of the border section 56 of the distal end side that starts from the second region Y from interfering with the side walls 29 of the distal end side of the first boom 18A in the case that the second boom 18B swings downward in relation to the first boom 18A.

If the second region Y of the second boom 18B is excessively long in the lengthwise direction of the boom, the strength of the second region Y of the second boom 18B is reduced.

In the second boom 18B in the present embodiment, the distance D1 from the base side pivot center (axial center of the boss 57) O1 in the pivoted coupling section for the first boom 18A to the border section 56 is substantially ⅓ the distance D2 from the base side pivot center O1 to the distal end side pivot center (axial center of the boss 65) O2 in the pivoted coupling section for the arm 19.

The strength of the second region Y of the second boom 18B is thereby assured, and the vertical swing range of the second boom 18B is also assured in relation to the first boom 18A.

In comparison to the total length of the second boom 18B, the second region Y is formed with a length that is substantially ⅓ the total length of the second boom 18B, and the first region X and third region Z are also formed with a length that is substantially ⅓ the total length of the second boom 18B.

Adopted in the backhoe 1 of this configuration are a pivoted coupling member 26 and arm 19 that are similar to a standard working device that is provided with a boom integrally formed from the base end side to the distal end side.

INDUSTRIAL APPLICABILITY

The present invention can be used as a boom for backhoes and other work machinery.

The invention claimed is:

1. A boom for a work vehicle comprising:

a first boom having a base end side and a distal end side and comprising a first boom main body portion formed from right side, left side, top, and bottom walls extending between the base end side and the distal end side of the first boom, the first boom having, on the base end side, a pivoted coupling member pivotally coupleable to a boom support section of a running body of the work vehicle; and a second boom having a base end side and a distal end side and comprising a second boom main body portion formed from right side, left side, top, and bottom walls extending between the base end side and the distal end side of the second boom, the second boom having its base end side pivotally coupled to the distal end side of the first boom and in which an arm is pivotably coupled to the distal end side of the second boom;

wherein a lateral width of the second boom main body portion is set to be smaller in a second region at the base end side of the second boom than in a first region at the distal end side;

the base end side of the second boom is inserted between the left and right side walls of the distal end side of the first boom, and the second boom is pivotably coupled to the first boom to form a pivoted coupling section so as to be capable of rotation about a lateral axis; and the lateral width of the first region of the second boom main body portion and a lateral width of the first boom are formed so as to be substantially the same so that the pivoted coupling member of the base end side of the first boom is configured to be shared with a pivoted coupling member of a standard boom.

2. The boom according to claim 1, wherein a third region, in which the lateral width of the second boom main body portion continuously narrows from the first region to the second region, is disposed between the first region and the second region.

3. The boom according to claim 2, wherein vertical widths of the left and right side walls of the second boom are set so that the vertical widths of the left and right side walls of the second boom are maximal in a vicinity of a border section between the second region and the third region of the second boom main body portion.

4. The boom according to claim 3, wherein a lower edge side of the second region of the second boom main body portion is configured so as to enter between the left and right side walls of the distal end side of the first boom when the second boom is caused to swing downward with respect to the first boom.

5. The boom according to claim 3, wherein a distance from a pivot center of the base end side of the second boom in the pivoted coupling section to a border section between the second region and the third region of the second boom is substantially ⅓ of a distance from the pivot center of the base end side of the second boom to a pivot center of the distal end side of the second boom in which the arm is coupled.

6. The boom according to claim 4, wherein a distance from a pivot center of the base end side of the second boom in the pivoted coupling section to a border section between the second region and the third region of the second boom is substantially ⅓ of a distance from the pivot center of the base end side of the second boom to a pivot center of the distal end side of the second boom in which the arm is coupled.

* * * * *